US007958951B2

(12) United States Patent
Lassoie et al.

(10) Patent No.: US 7,958,951 B2
(45) **Date of Patent: *Jun. 14, 2011**

(54) METHOD FOR ASSEMBLING AN UNDERREAMING TOOL

(75) Inventors: Jean-Pierre Lassoie, Brussels (BE); Valerie Sillen, Brussels (BE); Philippe Fanuel, Brussels (BE); Olivier Mageren, Gilly (BE)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/645,865

(22) Filed: Dec. 23, 2009

(65) Prior Publication Data

US 2010/0096191 A1 Apr. 22, 2010

Related U.S. Application Data

(63) Continuation of application No. 12/100,797, filed on Apr. 10, 2008, now Pat. No. 7,654,342.

(51) Int. Cl.
*E21B 10/32* (2006.01)

(52) U.S. Cl. ..... 175/57; 175/269; 175/286; 175/406

(58) Field of Classification Search ..... 175/267, 175/269, 286, 289, 57
See application file for complete search history.

(56) References Cited

U.S. PATENT DOCUMENTS

| | | | | |
|---|---|---|---|---|
| 1,804,850 | A | 5/1931 | Triplett et al. | 175/271 |
| 3,224,507 | A * | 12/1965 | Cordary et al. | 166/55.8 |
| 5,368,114 | A | 11/1994 | Tandberg et al. | |
| 6,213,226 | B1 * | 4/2001 | Eppink et al. | 175/61 |
| 6,615,933 | B1 * | 9/2003 | Eddison | 175/284 |
| 7,252,163 | B2 * | 8/2007 | Ollerenshaw et al. | 175/269 |
| 2005/0241856 | A1 | 11/2005 | Lassoie et al. | 175/57 |
| 2007/0089912 | A1 * | 4/2007 | Eddison et al. | 175/269 |

FOREIGN PATENT DOCUMENTS

| | | |
|---|---|---|
| EP | 0 397 417 | 11/1990 |
| WO | 2004/097163 | 11/2004 |

OTHER PUBLICATIONS

International Search Report, PCT/BE2005/000145, 4 pgs, Jun. 12, 2006.

* cited by examiner

*Primary Examiner* — David J Bagnell
*Assistant Examiner* — Robert E Fuller
(74) *Attorney, Agent, or Firm* — Baker Botts L.L.P.

(57) ABSTRACT

An underreaming tool may include a tubular body, a drive tube, at least one blade element ("the blade element"), at least one wedge element ("the wedge element"), and a stop mechanism. The drive tube may include at least one longitudinal groove ("the longitudinal groove") axially disposed along a length of the drive tube. The wedge element may include a first side having at least one lateral projection ("the lateral projection") configured to axially slide into the longitudinal groove to couple the wedge element to the drive tube. The stop mechanism comprises a threaded sleeve configured to screw onto the drive tube to lock the wedge element in the longitudinal groove once the lateral projection is slid into the longitudinal groove.

6 Claims, 12 Drawing Sheets

METHOD FOR ASSEMBLING AN UNDERREAMING TOOL

CROSS REFERENCE TO RELATED APPLICATIONS

This application is a Continuation of U.S. patent application Ser. No. 12/100,797 filed on Apr. 10, 2008, which is a continuation of co-pending International Application No. PCT/BE2005/000145, with an international filing date of Oct. 11, 2005, which designates the United States, each of which are hereby incorporated in their entirety by reference.

TECHNICAL FIELD

The present disclosure relates generally to earth formation drilling, and more particularly to an underreaming and stabilization tool for use in a borehole and a method for its use.

BACKGROUND

Earth formation drilling is often accomplished using a long string of drilling pipes and tools coupled together. The drilling string may be rotated in order to rotate a cutting bit at the end of the string. This cutting bit creates the hole through which the rest of the drilling string moves. For various reasons, it may be desirable to widen the walls of the hole after it has been created by the cutting bit. Borehole underreamers exist to accomplish the widening of the hole. An underreamer may be coupled to the drilling string between two other elements of the drilling string. It may then be sent down the hole with the drilling string, rotating with the drilling string, and widening the hole.

SUMMARY

To facilitate drilling in hard and/or abrasive geological formations, an underreaming tool may include a number of elongate blade elements each comprising a plurality of cutting tips. In particular embodiments, the blade elements of the underreaming tool may be reinforced with diamond domes (e.g., to stabilize the underreaming tool during broadening of a drilling hole). The cutting tips of the blade elements may be oriented such that the underreaming tool may widen a drilling hole during downward descent in the hole and during upward retraction from the hole.

As an underreaming tool progresses through a drilling hole, it may encounter numerous different geological formations and materials. In certain instances, particular underreaming tools may need to be completely replaced when there is a transition between geological formations due to the fact that certain underreaming tools may only be adequate for use in one type of geological formation. For example, complete replacement of an underreaming tool may require an operator to extract the underreaming tool from the string and replace it with another underreaming tool, the configuration of which is better suited to the widening of the borehole in the new geological formation. An operator may also have to completely replace an underreaming tool in the event of wear or fault in the blade elements. Such complete replacement of underreaming tools may result in high operating cost.

The present disclosure relates generally to an underreaming and stabilization tool that may be used in a borehole and which may be quickly disassembled and reassembled, for example, to replace one or more components. In particular embodiments, an underreaming tool for use in a borehole according to the present disclosure may include a tubular body, a drive tube, at least one blade element ("the blade element"), at least one wedge element ("the wedge element"), and a stop mechanism. The tubular body may include an axial cavity spanning an entire length of the tubular body and configured to house the drive tube. The tubular body may further include at least one guide channel ("the guide channel") configured to, at least, partially house the blade element and the wedge element wherein the guide channel may be an opening in the tubular body that opens into the axial cavity. The drive tube may include at least one longitudinal groove ("the longitudinal groove") axially disposed along a length of the drive tube. The wedge element may include a first side having at least one lateral projection ("the lateral projection") configured to axially slide into the longitudinal groove to couple the wedge element to the drive tube and a second side configured to slideably couple the wedge element to the blade element. The stop mechanism comprises a threaded sleeve configured to screw onto the drive tube to lock the wedge element in the longitudinal groove once the lateral projection is slid into the longitudinal groove. Furthermore, once the stop mechanism locks the wedge element into the longitudinal groove while the drive tube is housed in the axial cavity and the blade element is housed in the guide channel, the drive tube may be operable to raise the blade element out of the guide channel by moving along the length of the tubular body.

In particular embodiments, the longitudinal groove may include at least one lip ("the lip") and the lateral projection may axially slide into the longitudinal groove by sliding beneath the lip.

In particular embodiments, the lip may prevent radial movement of the wedge element relative to the drive tube once the lateral projection is slide underneath the lip and the threaded sleeve may prevent axial movement of the wedge element relative to the drive tube once the threaded sleeve is screwed onto the drive tube.

In particular embodiments, the longitudinal groove may include a splay disposed in a central section of the longitudinal groove. Additionally, the lateral projection on the first side of the wedge element may include a first set of lateral projections and a second set of lateral projections. The first set of lateral projections may axially slide into the longitudinal groove through the splay and the second set of lateral projections may axially slide into the longitudinal groove through an end of the longitudinal groove.

In particular embodiments, the stop mechanism may include a stop wall that defines a first end of the longitudinal groove. The threaded sleeve, after being screwed onto the drive tube, may close a second end of the longitudinal groove forming an opposing wall to the stop wall such that the stop mechanism locks the wedge element into the longitudinal groove by trapping the first side of the wedge element between the stop wall and the threaded sleeve once the lateral projection is slid into the longitudinal groove.

In particular embodiments, a first side of the blade element may have a first angled surface and the second side of the wedge element comprises a second angled surface. When the wedge element slideably couples the blade element to the drive tube, an incline of the first angled surface may oppose an incline of the second angled surface. Furthermore, the drive tube may be operable to raise the at least one blade element out of the guide channel by thrusting the first angled surface against the second angled surface such that the second angled surface slides beneath the first angled surface forcing the blade element out of the guide channel.

In particular embodiments, the first angled surface of the blade element may be slideably coupled to the second angled surface of the wedge element by a dovetail groove and a corresponding flute that fits within the dovetail groove. Furthermore, the flute may be operable to slide within the dovetail groove once engaged with the dovetail groove, and the dovetail groove may be operable to prevent the flute from lifting out of the dovetail groove.

In particular embodiments, the underreaming tool may further include a pin that may temporarily connect the blade element to the wedge element. The pin may generally prevent slideable movement of the blade element relative to the wedge element until the drive tube is moved along the length of the tubular body with a predefined force sufficient to shear the pin.

In particular embodiments, the underreaming tool may further include a piston coupled to the drive tube, the piston operable to exert mechanical force on the drive tube to move the drive tube along the length of the tubular body once the drive tube and piston are housed in the axial cavity.

In particular embodiments, the piston may separate, in the tubular body, a first pressurized portion of the axial cavity from a second portion of the axial cavity wherein the second portion is open to the outside of the tubular body through the guide channel. The drive tube may further include a plurality of drillings operable to filter and communicate hydraulic fluid contained inside the drive tube to the first pressurized portion of the axial cavity at an internal hydraulic pressure.

In particular embodiments, the underreaming tool may further include an activation device that may initially hold the drive tube at an initial position in which the blade element is recessed within the guide channel. After the occurrence of a predefined condition, the activation device may release the drive tube to move along the length of the tubular body. Furthermore, the underreaming tool may further include a return spring that opposes the movement of the drive tube caused by the piston and may be operable to return the drive tube to the initial position once a hydraulic pressure at the piston drops below a threshold amount such that a force exerted on the drive tube by the return spring overcomes the force exerted on the drive tube by the piston.

In particular embodiments, the underreaming tool may further include a capture device operable to capture the drive tube in the initial position once the return spring returns the drive tube to the initial position.

In particular embodiments, a method for using an underreaming tool may include the steps of providing a tubular body, a drive tube, at least one blade element ("the blade element"), at least one wedge element ("the wedge element"), and a stop mechanism. The method may further include the steps of assembling the underreaming tool by coupling the wedge element to the blade element, housing the blade element in the guide channel, inserting the drive tube into the axial cavity, sliding the lateral projection into the longitudinal groove, and screwing the threaded sleeve onto the drive tube. The tubular body may include an axial cavity axial cavity spanning an entire length of the tubular body and configured to house the drive tube. The tubular body may further include at least one guide channel ("the guide channel") configured to, at least, partially house the blade element and the wedge element wherein the guide channel may be an opening in the tubular body that opens into the axial cavity. The drive tube may include at least one longitudinal groove ("the longitudinal groove") axially disposed along a length of the drive tube. The wedge element may include a first side having at least one lateral projection ("the lateral projection") configured to axially slide into the longitudinal groove to couple the wedge element to the drive tube and a second side configured to slideably couple the wedge element to the blade element. The stop mechanism may include a threaded sleeve configured to screw onto the drive tube to lock the wedge element in the longitudinal groove once the lateral projection is slid into the longitudinal groove.

In particular embodiments, the longitudinal groove may include a splay disposed in a central section of the longitudinal groove. Additionally, the lateral projection may include a first set of lateral projections and a second set of lateral projections. Furthermore the step of sliding the lateral projection into the longitudinal groove may further include the step of sliding the first set of lateral projections into the longitudinal groove through the splay and the second set of lateral projections into the longitudinal groove through an end of the longitudinal groove.

In particular embodiments, the step of housing the blade element in the guide channel may include the step of inserting the blade element into the axial cavity through the guide channel and raising the blade element into the guide channel. Additionally the step of inserting the drive tube into the axial cavity may include the step of inserting the drive tube into a first end of the tubular body. Furthermore the step of screwing the threaded sleeve onto the drive tube may include the step of inserting the threaded sleeve into a second end opposite the first end of the tubular body after inserting the drive tube into the tubular body, and screwing the threaded sleeve onto the drive tube inside the tubular body.

In particular embodiments, the step of assembling the drive tube may include the chronological steps of first, coupling the wedge element to the blade element, second, housing the blade element in the guide channel, third, inserting the drive tube into the axial cavity, fourth, sliding the lateral projection into the longitudinal groove, and fifth, screwing the threaded sleeve onto the drive tube.

In particular embodiments, a method for using an underreaming tool may include rigidly coupling at least one wedge element ("the wedge element") to a drive tube using a stop mechanism. The stop mechanism may rigidly couple the wedge element to the drive tube by attaching to the drive tube such that the stop mechanism, at least, partially traps the wedge element between itself and the drive tube.

Particular embodiments of the present disclosure may provide one or more technical advantages. For instance, particular embodiments of the present disclosure may provide for easy replacement of particular components of the underreaming tool (e.g., a wedge element and/or a blade element of the underreaming tool). More particularly, when faced with a relatively hard geological formation, particular embodiments of the present disclosure may allow poorly suited blade elements to be quickly replaced with better suited blade elements that may react more flexibly to the hard formation. For example, blade elements and wedge elements having a relatively steep incline may be better suited for use in hard rock formations since the relatively steep incline may enable the blade element to react more flexibly to the harder rock. By contrast, blade elements and wedge elements having a relatively moderate incline may be better suited for use in a friable geological formation since the relatively moderate incline may enable the blade element to react more aggressively to the softer formation. Consequently, particular embodiments of the present disclosure may be modified on the fly to suit particular types of geological formations by replacing unsuited wedge elements and blade elements with better-suited wedge elements and blade elements rather than replacing the entire underreaming tool. Particular embodiment of the present disclosure may further enable an operator to use blade elements having different active lengths in the same radial guide channels without changing underreaming tools.

Additionally, particular embodiments of the present disclosure may provide for easy replacement of worn or broken blade elements.

Other technical advantages of particular embodiments of the present disclosure will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present disclosure and its advantages, reference is now made to the following descriptions, taken in conjunction with the accompanying drawings, in which.

DETAILED DESCRIPTION OF EXAMPLE EMBODIMENTS

Figure 1:
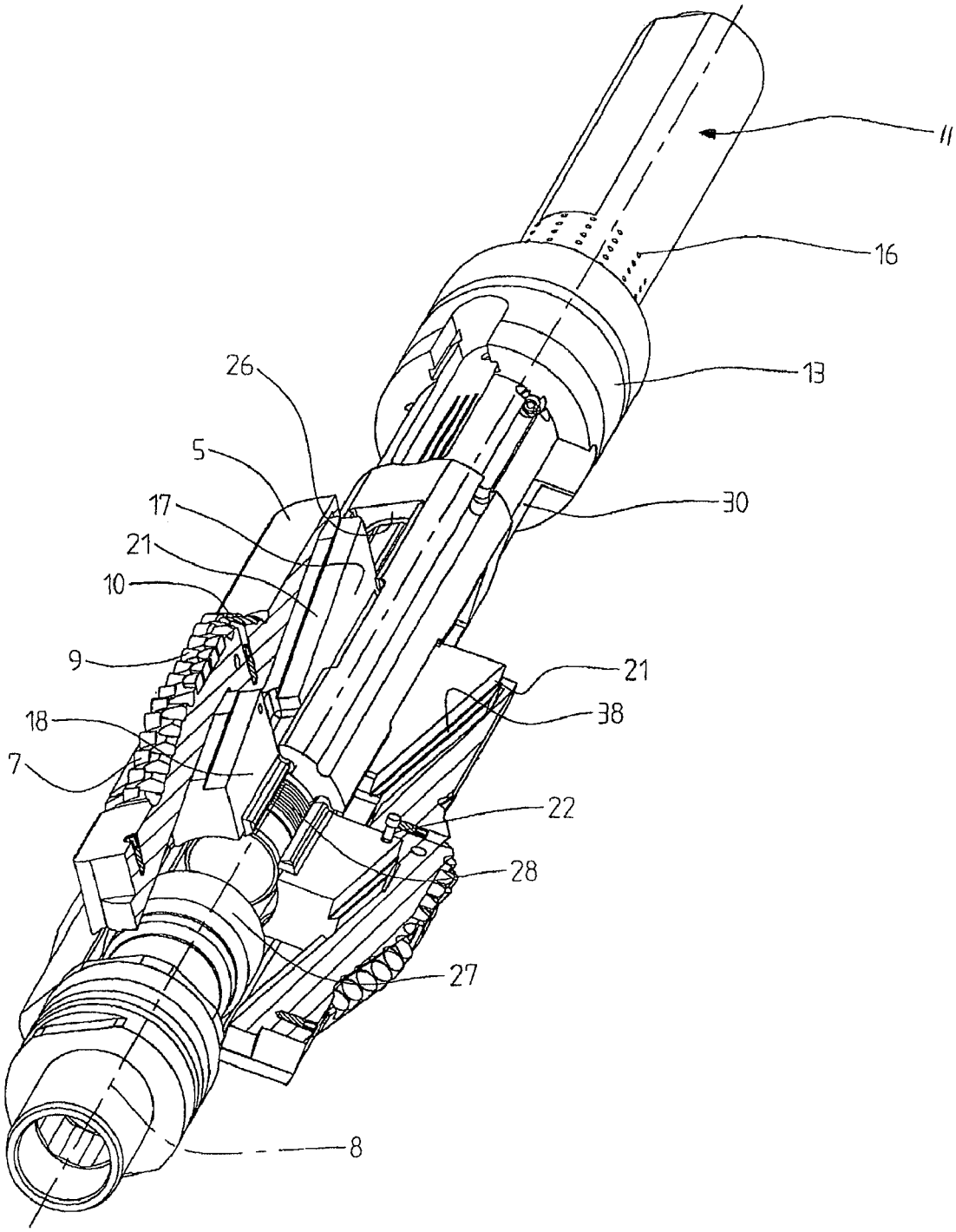
FIG. 1 illustrates a partially cut-away perspective view of an example drive tube as well as example wedge elements and blade elements that may be attached thereto in accordance with an example embodiment of the present disclosure.
Figure 2:
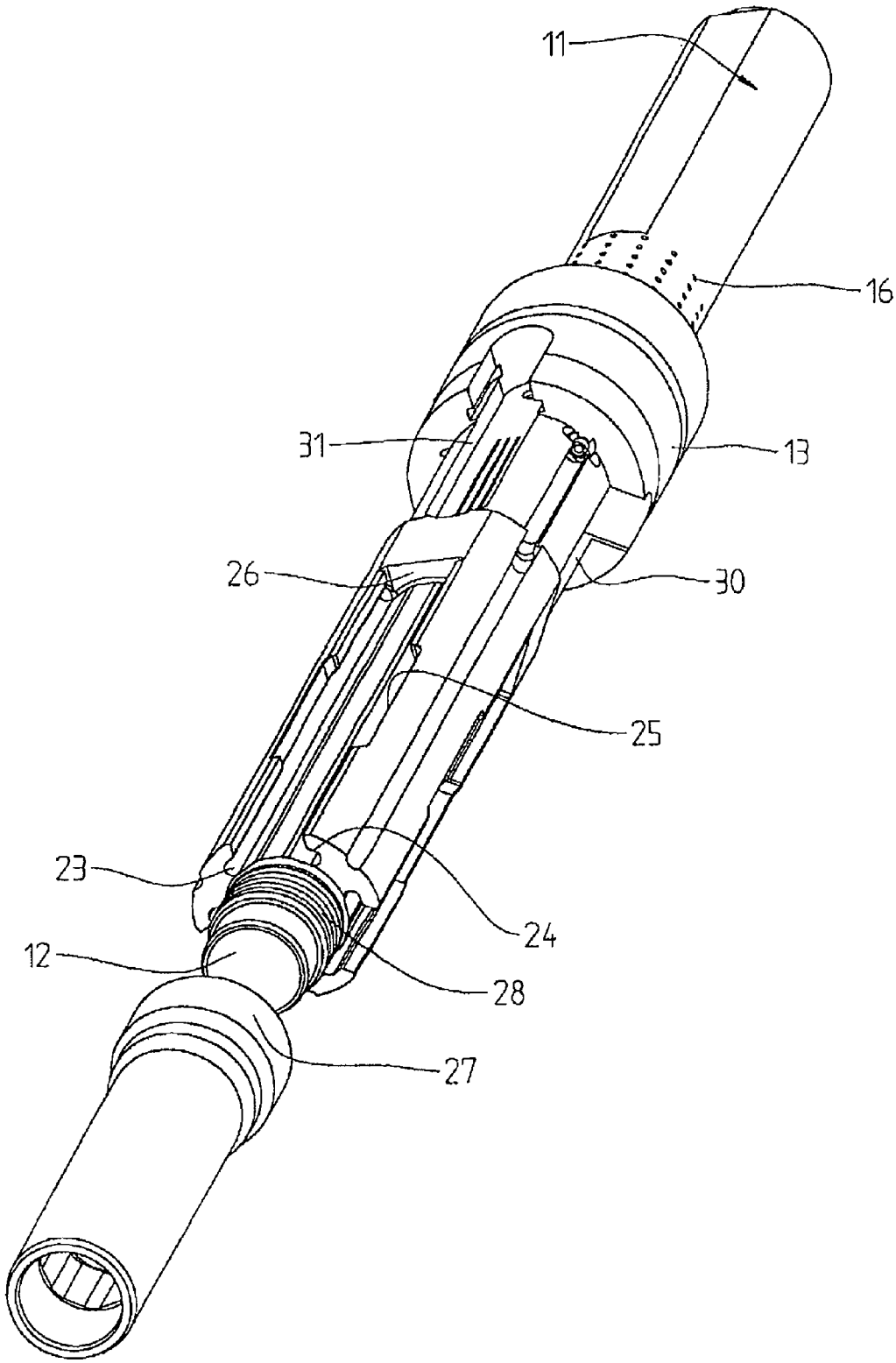
FIG. 2 illustrates a perspective view of the drive tube of FIG. 1.
Figure 3:
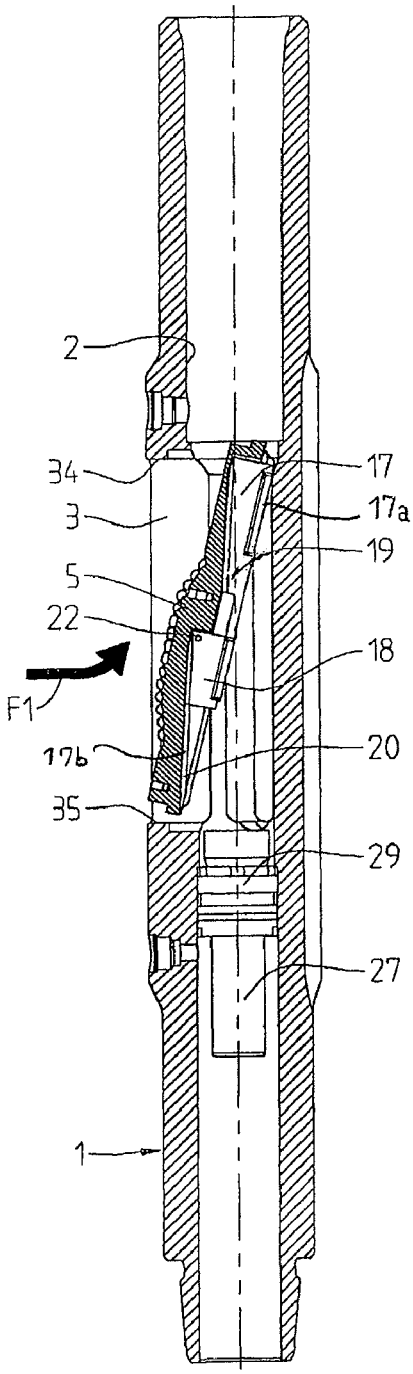
FIGS. 3-6 illustrate example steps for assembling an example underreaming tool by attaching the wedge elements and blade elements FIG. 1 to the drive tube of FIG. 1 within a tubular body according to the present disclosure.

FIGS. 1-3 illustrate particular components of an example underreaming tool 0 that may be used in a borehole according to an example embodiment of the present disclosure. The example components of FIGS. 1-3 may be assembled in accordance with the present disclosure to form the example embodiment of underreaming tool 0 illustrated in FIG. 6.

Referring to FIG. 3, underreaming tool 0 may comprises a tubular body 1 that may be mounted between two sections of a drilling string (not shown). Tubular body 1 may include an axial cavity 2 open towards the outside of tubular body 1 through one or more radial guide channels 3. As an example and not by way of limitation, tubular body 1 may have three radial guide channels 3, only one of which is visible in FIG. 3. In particular embodiments, a blade element 5 may be housed in each guide channel 3 so as to be radially movable relative to tubular body 1 (e.g., blade element 5 may be raised and lowered in guide channel 3) when coupled to a drive tube 11 that may be housed in axial cavity 2 (see FIG. 6).

Referring to FIG. 1, each blade element 5 may have an external surface that includes a plurality of cutting tips. In particular embodiments, blade element 5 may include a front part 7 inclined towards the front (that is to say towards the bottom of FIG. 1) with respect to the longitudinal axis 8, a central part 9 substantially parallel to the axis 8, and a rear part 10 inclined towards the rear with respect to the axis 8. During operation in a borehole, the front part 7 may widen the borehole during descent of underreaming tool 0 in the borehole, the central part 9 may stabilize underreaming tool 0 with respect to the widened hole, and the rear part 10 may widen the borehole when underreaming tool 0 is raised from the borehole. Underreaming tool 0 may further include a drive tube 11 that may be mounted inside axial cavity 2 and, once mounted therein, may move longitudinally along the length of axial cavity 2 when subjected to hydraulic pressure in order to raise and lower blade elements 5 relative to their respective guide channels 3. For the purposes of this description, longitudinal or axial movement may be defined as movement at least substantially parallel to the longitudinal axis 8. Radial movement may be defined as movement at least substantially perpendicular to, or in a plane at least substantially perpendicular to, longitudinal axis 8.

In particular embodiments, drive tube 11 may include a piston 13 operable to move drive tube 11 along the length of tubular body 1 using hydraulic pressure. For example, piston 13, once mounted in tubular body 1, may separate a first pressurized portion 14 (see FIG. 8) of axial cavity 2 from a second portion 15 (see FIG. 9) of axial cavity 2 that includes blade elements 5 housed in guide channels 3. During drilling, hydraulic fluid (e.g., drilling mud) may enter first pressurized portion 14 under pressure from an axial cavity 12 in drive tube 11 by passing through a filtration mechanism formed by a plurality of drillings 16 in drive tube 11. As the hydraulic pressure in pressurized portion 14 builds at piston 13, piston 13 exerts mechanical force on drive tube 11 causing drive tube 11 to move along the length of drive tube 11. In particular embodiments, piston 13 may be driven, in part or in whole, by a mechanical mechanism situated for example above underreaming tool 0. As piston 13 moves drive tube along the length of drive tube 11, drive tube 11 may push blade elements 5 out of their respective guide channels 3 in the second portion 15 of the tubular body 1. Thus, the second portion 15 may be in communication with the outside of tubular body 1 through the guide channels 3 where the blade elements 5 are housed.

In particular embodiments, piston 13 may include one or more small-diameter conduits 36 (see FIG. 9) that may allow hydraulically pressurized fluid travel from pressurized portion 14 to portion 15. For example, during drilling, conduits 36 may inject high-pressure jets of hydraulic fluid from pressurized portion 14 into portion 15 to prevent the drilling mud that flows outside the string from penetrating into underreaming tool 0 as well as to clean particular components of underreaming tool 0 (e.g., wedge elements 17 and 18, blade elements 5, and radial guide channels 3).

Referring to FIG. 1, in particular embodiments, each blade element 5 may be slideably coupled to drive tube 11 by one or more wedge elements 17 and 18. For example, a first side 17*a* of each wedge element 17 and 18 may be rigidly coupled to and supported by drive tube 11 while a second side 17*b* of each wedge element 17 and 18 may be slideably coupled to blade element 5. More particularly, each blade element 5 may have at least one internal surface 19 inclined with respect to the longitudinal axis 8 once blade element 5 is coupled to drive tube 11 by wedge elements 17 and 18. Additionally, each of wedge elements 17 and 18 may have a similarly inclined external surface 21 that opposes the incline of the internal surface 19 of blade element 5 when wedge elements 17 and 18 are coupled to blade element 5.

Figure 12:
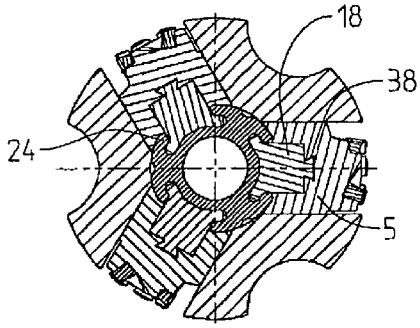
FIG. 12 illustrates a cross-section view of the underreaming tool of FIG. 9 cut along line XII in FIG. 9.

In particular embodiments, blade element 5 and wedge elements 17 and 18 may include a mutual holding mechanism that holds blade element 5 together with wedge elements 17 and 18 while allowing slideable motion of blade element 5 relative to wedge elements 17 and 18. As an example and not by way of limitation, each blade element 5 may have a U-shaped transverse section that straddles wedge element 17 and 18 (see FIG. 12). More particularly, angled surface 19 of blade element 5 and angled surface 21 of wedge elements 18 may include a dovetail groove and a flute 38 of corresponding shape that fits therein to hold blade element 5 and wedge elements 17 and 18 together.

Figure 11:
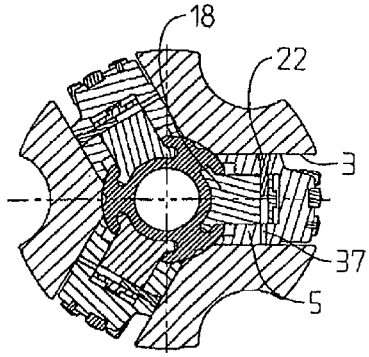
FIG. 11 illustrates a cross-section view of the underreaming tool of FIG. 9 cut along line XI in FIG. 9.
Figure 19:
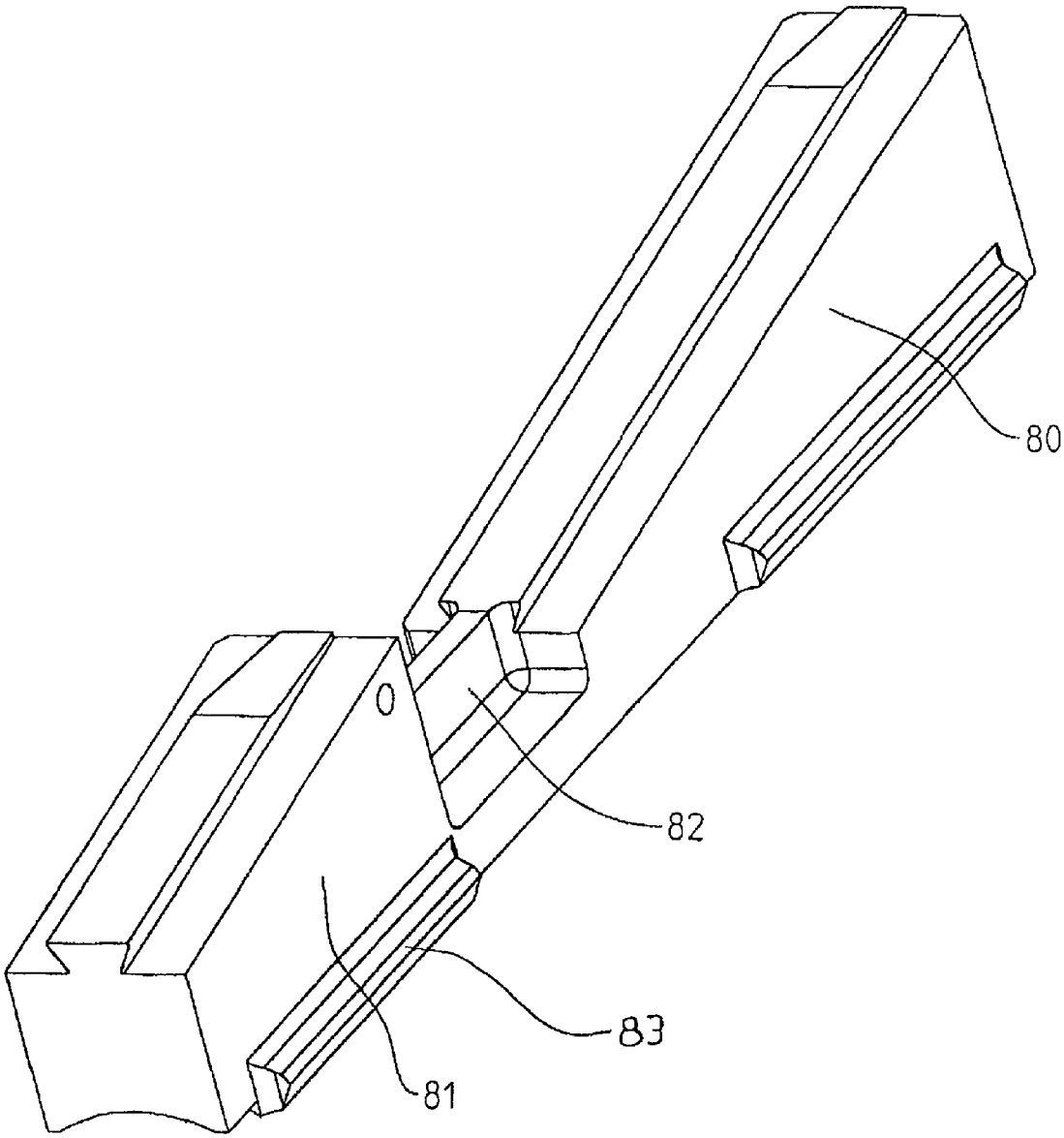
FIG. 19 illustrates an enlarged perspective view of an example embodiment of a wedge element according to the present disclosure.

In particular embodiments, wedge element 17 may be rigidly coupled to wedge element 18 by a strut 82 (e.g., wedge elements 17 and 18 may be a single element), thus allowing wedge elements 17 and 18 to be manipulated as one piece (see FIG. 19). Rigidly coupling wedge element 17 to wedge element 18 may provide excellent resistance to tilting of the wedge elements 17 and 18 in the grooves and therefore may avoid any unwanted jamming of the wedge elements 17 and 18. Furthermore, in particular embodiments, wedge elements 17 and 18 may be fixed to blade element 5 by one or more shear pins 22 that temporarily holds wedge elements 17 and 18 immobile with respect to blade element 5 during mounting (see FIGS. 3 to 6). For example, before assembling underreaming tool 0, pins 22 may be introduced into blade element 5 through a perforation 37 and into wedge elements 17 and 18 through a corresponding perforation in wedge elements 17 and 18 (see FIG. 11). Once underreaming tool has been assembled, shear pin 22 may be sheared off by the movement of drive tube 11 in axial cavity 2, freeing blade element 5 to slide up and down along wedge elements 17 and 18.

Figure 5:
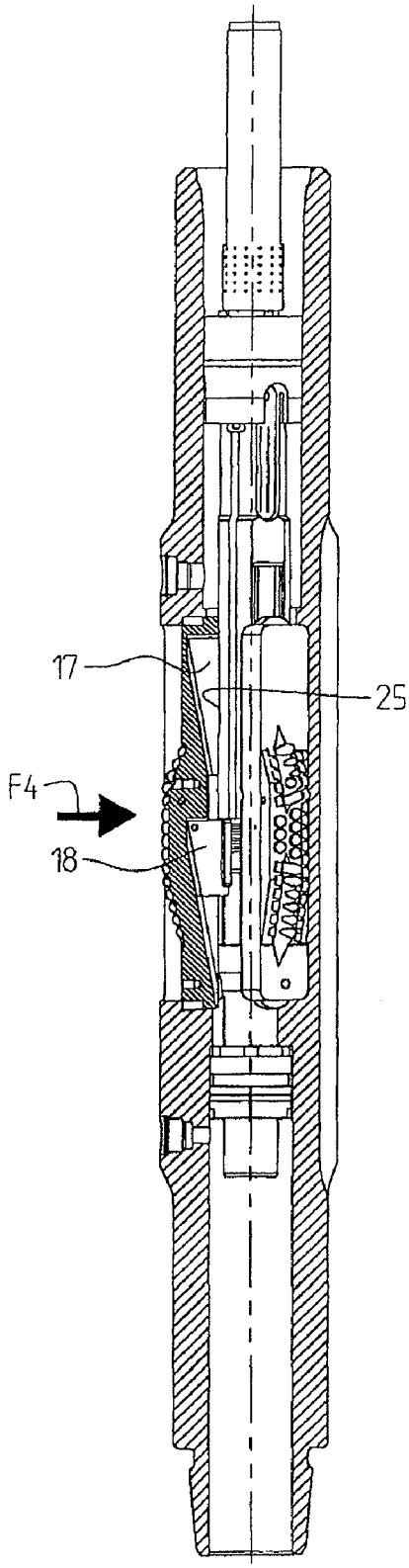
Figure 6:
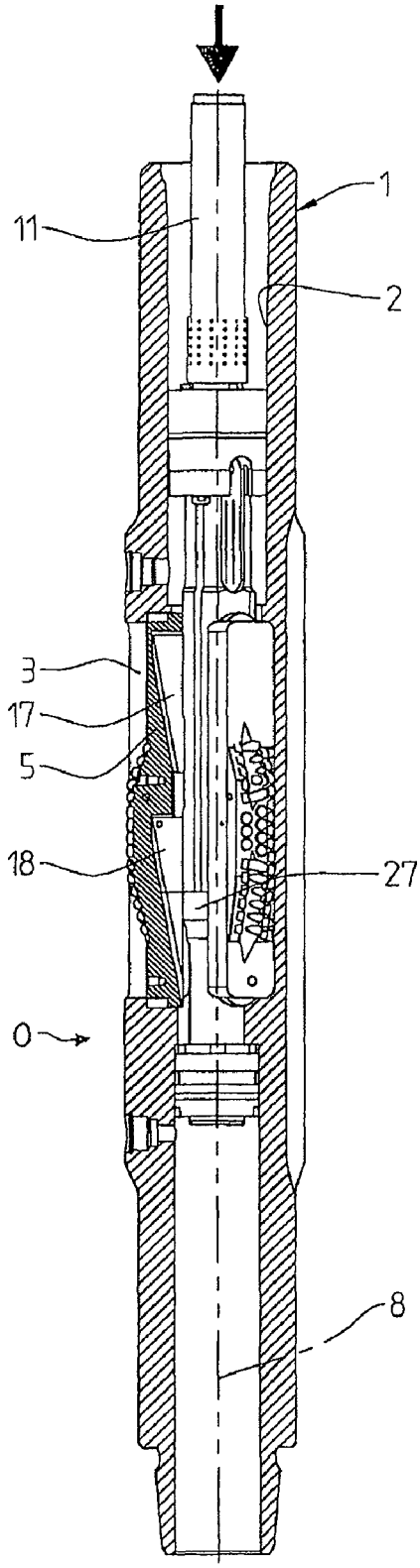

In particular embodiments, wedge elements 17 and 18 may be rigidly coupled to drive tube 11 using one or more longitudinal grooves 23 on the surface of drive tube 11 (see FIG. 2). More particularly, wedge elements 17 and 18 may be mounted on drive tube 11 by sliding one or more lateral projections 83 on side 17*a* of wedge elements 17 and 18 into longitudinal grooves 23 as shown in FIGS. 5 and 6.

As an example and not by way of limitation, each of longitudinal grooves 23 may include a pair of lips 24 spanning over the length of longitudinal grooves 23, except that, a portion of lips 24 (e.g., approximately corresponding in size to lateral projections 83) may be omitted in a central section of lateral grooves 23 to form a splay 25. Splay 25 may allow one or more lateral projections 83 on wedge elements 17 and 18 to be inserted into the central section of longitudinal grooves 23 from the top (e.g., in the radial direction). For example, a first set of lateral projections 83 may be slid underneath lips 24 through splay 25 and a second set of lateral projections 83 may be slid underneath lips 24 from the end of longitudinal grooves 23 (see FIG. 1).

In particular embodiments, wedge elements 17, 18 may be detachably locked onto drive tube 11. For example, underreaming tool 0 may comprise a stop mechanism capable of detachably locking wedge elements 17 and 18 into longitudinal grooves 23. The stop mechanism may comprise a stop wall 26 that longitudinally delimits each longitudinal groove 23 and a threaded sleeve 27 that may be screwed onto a threaded end 28 of drive tube 11. Stop wall 26 may be a wall that terminates a first end of longitudinal grooves 23 nearest piston 13, and threaded sleeve 27, after being screwed onto threaded end 28, may close a second end longitudinal groove 23 forming an opposing wall to stop wall 26. Thus, once lateral projections 83 are slid into longitudinal grooves 23 such that wedge element 17 abuts stop wall 26, threaded sleeve 27 may be screwed onto threaded end 28 to entrap wedge elements 17 and 18 in longitudinal grooves 23.

Figure 7:
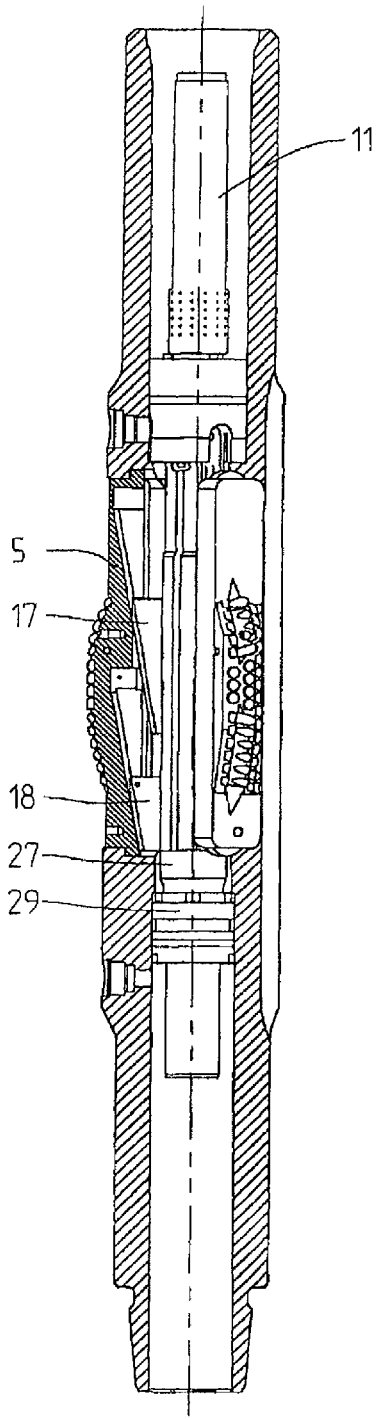
FIG. 7 illustrates an example embodiment of the assembled underreaming tool of FIG. 6 with the blade elements extended according to the present disclosure.

Once wedge elements 17 and 18 are coupled to drive tube 11 and to blade element 5 while each of these elements are housed within tubular body 1, drive tube 11 may raise and lower blade element 5 relative to guide channel 3 (e.g., from the position shown in FIG. 6 to the position shown in FIG. 7) by moving axially along the length of tubular body 1. More particularly, as drive tube 11 moves along the length of tubular body 1, it draws with it wedge elements 17 and 18 which are rigidly trapped in longitudinal grooves 23 by stop wall 26, threaded sleeve 27, and lips 24. As wedge elements 17 and 18 are drawn along by drive tube 11, wedge elements 17 and 18 may slide under the inclined face 19 of blade element 5 causing radial movement of each blade element 5 in its corresponding guide channel 3 (e.g., causing blade element 5 to raise out of or lower into guide channel 3 as wedge elements 17 and 18 move beneath it within axial cavity 2). The radial movement of blade element 5 may be caused, in part, by the front and rear walls 34 and 35 of guide channel 3 which prevent any axial movement of blade element 5 relative to tubular body 1 and therefore assist the inclined faces 19 and 21 of blade element 5 and wedge elements 17 and 18 in translating the axial movement of drive tube 11 into a corresponding radial movement (e.g., raising or lowering) of blade element 5 in guide channel 3. A retracted position of blade element 5 is illustrated in FIG. 6 and an extended position of blade element 5 is illustrated in FIG. 7.

In particular embodiments, underreaming tool 0 (and particular components thereof) may be quickly disassembled and/or reassembled according to the example process described below. To begin with, each blade element 5 may be coupled to one or more corresponding wedge elements 17 and 18 by, for example, sliding the dovetail flutes 38 of wedge elements 17 and 18 into the corresponding dovetail grooves in blade element 5. After sliding blade element 5 and wedge elements 17 and 18 together, wedge elements 17 and 18 may be temporarily fixed to blade element 5 by inserting one or more shear pins 22 through wedge elements 17 and 18 and into a corresponding orifice 37 in blade element 5 (see FIG. 11). After being secured together by shear pin 22, wedge elements 17 and 18 may remain secured to blade element 5 while wedge elements 17 and 18 are mounted to drive tube 11.

Referring to FIG. 3, after wedge elements 17 and 18 have been attached to blade element 5, blade element 5 may be mounted in guide channel 3 by holding blade element 5 radially aslant to axial cavity 2 and inserting blade element 5 into axial cavity 2 in the direction of arrow F1. Once blade element 5 is situated in radial guide channel 3 with its cutting face directed outward, blade element 5 may be drawn radially outwards in the direction of the arrow F2 (see FIG. 4), manually or by means of a machine, and may be kept in this extended position.

Threaded sleeve 27, may be introduced into axial cavity 2 from the bottom of tubular body 1. Threaded sleeve 27 may include a seal 29 in which threaded sleeve 27 is capable of sliding, once mounted in tubular body 1. Once threaded sleeve 27 is mounted in tubular body 1, seal 29 may be held in position between the threaded end of the sleeve 27 and return spring 42 (see FIG. 9).

Figure 4:
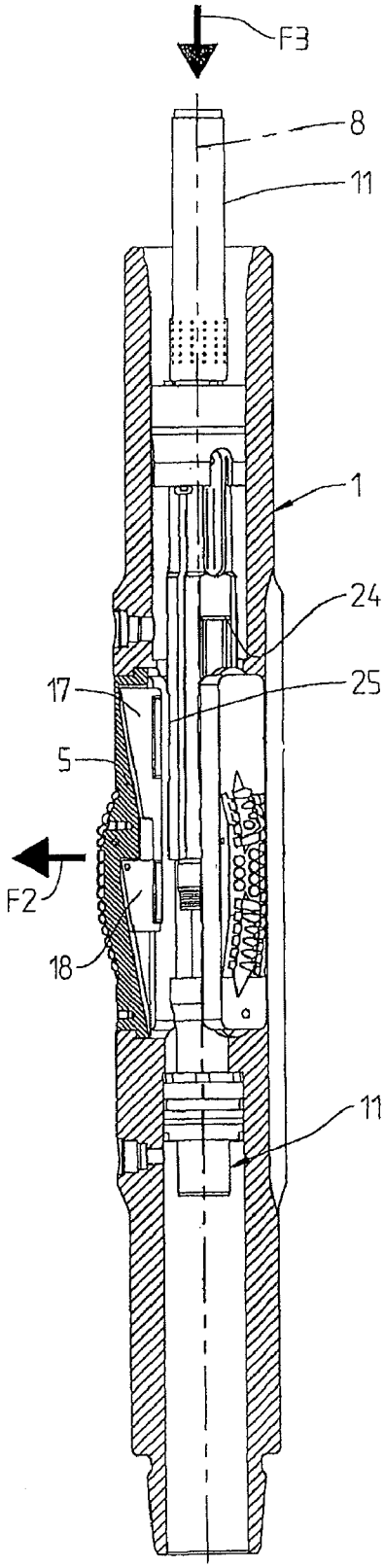

Referring to FIG. 4, after blade elements 5 have been housed in their corresponding guide channels 3, drive tube 11 may be introduced into axial cavity 2 from the top of tubular body 1 (e.g., in the direction of the arrow F3). Drive tube 11 may be positioned within tubular body 1 such that the splay 25 of the longitudinal grooves 23 in drive tube 11 are disposed opposite the lateral projections 83 of wedge elements 17 and 18.

Referring to FIG. 5, once splay 25 is disposed opposite lateral projections 83, blade element 5 may be pressed in the direction of the arrow F4 into guide channel 3 such that lateral projections 83 enter radially into longitudinal grooves 23, through splay 25.

Referring to FIG. 6, once lateral projections 83 pass below the level of lips 24, drive tube 11 may be slid further forward in axial cavity 2 such that lateral projections 83 slide beneath lips 24. In particular embodiments, a first set of lateral projections 83 on wedge element 17 may enter the central section of longitudinal grooves 23 through splay 25, while a second set of lateral projections 83 on wedge element 18 may enter longitudinal grooves 23 through the end of longitudinal grooves 23.

Once wedge elements 17 and 18 are slid into longitudinal grooves 23, threaded sleeve 27 may be screwed onto the threaded end 28 of drive tube 11 (e.g., from the bottom). Threaded sleeve 27 may trap wedge elements 17 and 18 in longitudinal grooves 23 between itself and stop walls 26 once threaded sleeve is screwed onto threaded end 28. Additionally, lips 24 may immobilize wedge elements 17 and 18 from moving radially relative to drive tube 11. Once mounted to drive tube 11, wedge elements 17 and 18 are rigidly coupled to drive tube 11 and may not slide axially relative drive tube 11. Rather, drive tube 11 draws wedge elements 17 and 18 with it during in its axial movements in axial cavity 2. Once underreaming tool 0 has been assembled as described above, hydraulic pressure may be applied at piston 13 to move drive tube 11 along the length of tubular body 1 to slide the inclined face 21 of wedge elements 17 and 18 beneath the inclined face 19 of blade element 5 to push and hold blade element 5 out of guide channel 3.

FIG. 7 illustrates an example situation where drive tube 11 has moved axially along the length tubular body 1 causing radial movement of blade element 5 (e.g., causing blade element 5 to raise out of guide channel 3). In the pictured embodiment, the angled surface 19 of blade element 5 has slid on the angled surface 21 of the wedge elements 17 and 18 to put blade element 5 in its fully extended position.

By disassembling and reassembling underreaming tool 0 as described above, an operator may quickly and easily repair and/or replace particular components of underreaming tool 0 (e.g., blade element 5 and wedge elements 17 and 18) without completely replacing underreaming tool 0.

Figure 8:
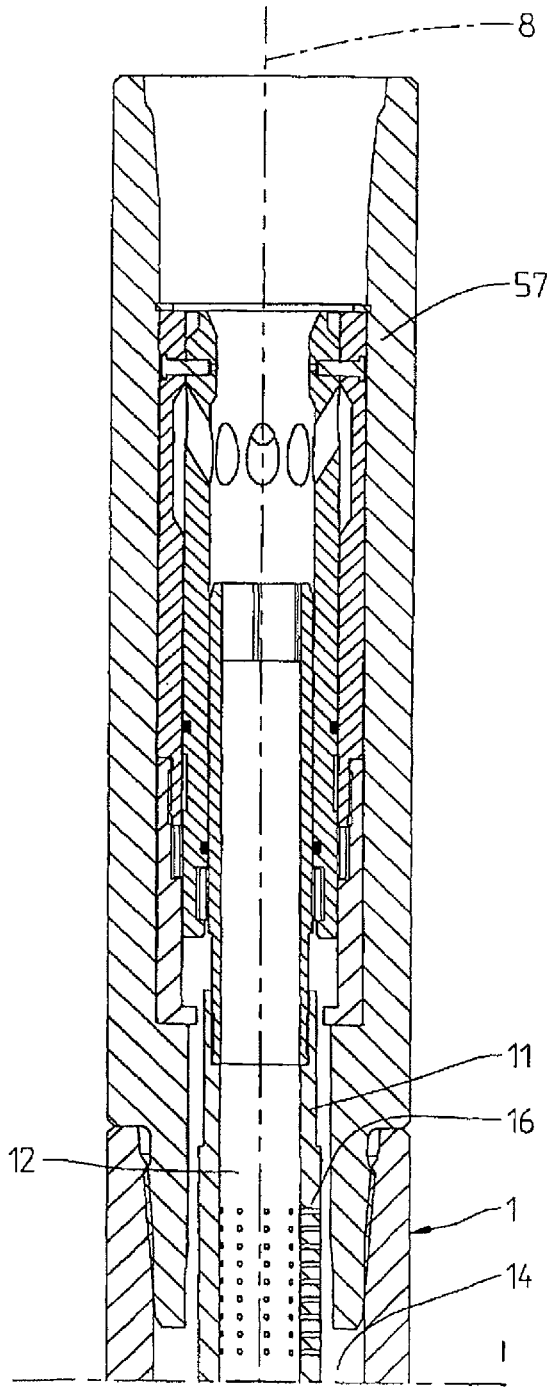
FIGS. 8-10 illustrate cross-section views of an example embodiment of an underreaming tool connected in a string by example joining elements disposed on either side of the underreaming tool in according to the present disclosure.
Figure 9:
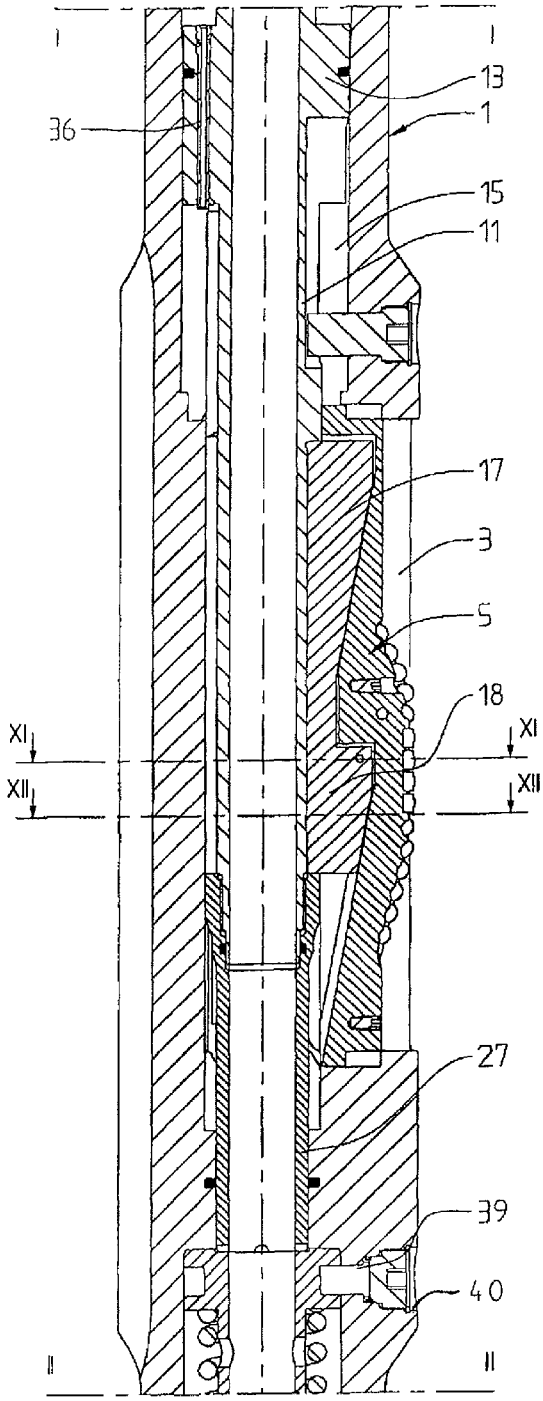
Figure 10:
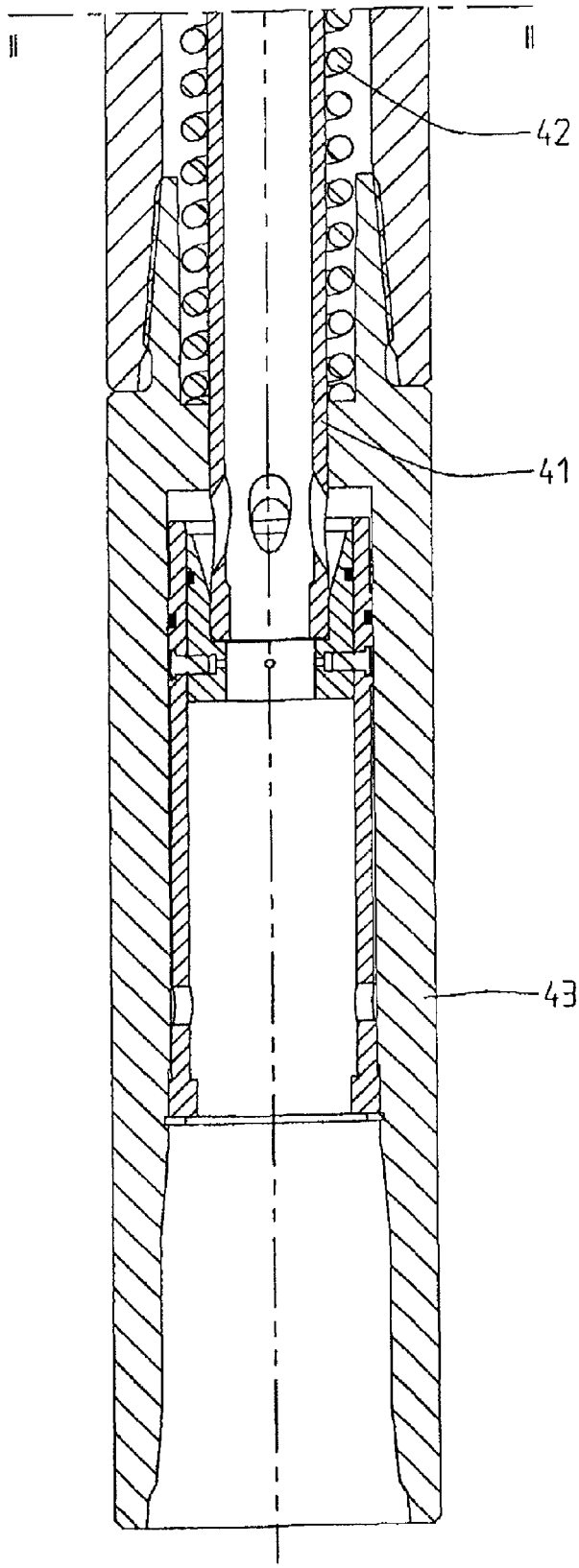

In particular embodiments, underreaming tool 0 may include an activation device capable of temporarily holding drive tube 11 axially in its initial position shown in FIGS. 8, 9 and 10 such that blade elements 5 are held retracted within their corresponding guide channels 3. For instance, drive tube 11 may be held in its initial position while underreaming tool 0 is inserted into a borehole. Activation device may be any mechanical device or fixture or combination of such devices or fixtures capable of temporarily holding drive tube 11 in its initial position. As an example and not by way of limitation, the activation device may comprise a shear pin 39 that passes through an orifice 40 provided in tubular body 1, entering a blind hole provided on an extension tube 41 extending from threaded sleeve 27. When the hydraulic pressure at piston 13 is below a given threshold, pin 39 may prevent any axial movement of extension tube 41 and drive tube 11; however, when this pressure threshold is surpassed, pin 39 is sheared, releasing drive tube 11 to move within tubular body 1.

Figure 13:
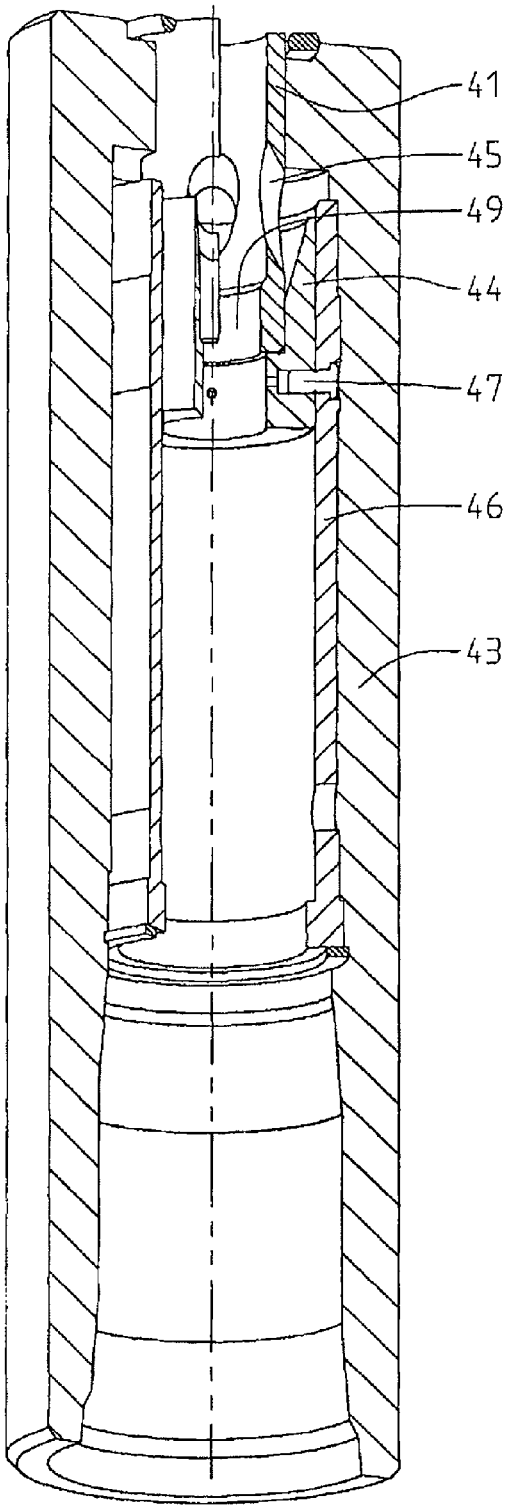
FIGS. 13-15 each illustrate a partially cut-away perspective view of an activation device in three different positions for activating an underreaming tool according to an example embodiment of the present disclosure.

As an additional example and not by way of limitation (referring to FIGS. 13 to 15), the activation device may comprise, at a first end of extension tube 41, a socket 44 enveloping said first end, said first end being opposite a second end of extension tube 41 that contacts threaded sleeve 27. Extension tube 41 may include several lateral holes 45 at its first end. Socket 44 may be designed to slide inside a sleeve 46 that is incorporated fixedly in an adjoining element 43. A shear pin 47 may hold socket 44 in place over the first end of the extension tube 41, corresponding to the initial position of drive tube 11. When held in position by shear pin 47, socket 44 may prevent any axial movement of extension tube 41 and therefore of drive tube 11. During operation, drilling mud passes through drive tube 11, threaded sleeve 27, extension tube 41 and sleeve 46 and then rejoins the string.

Figure 14:
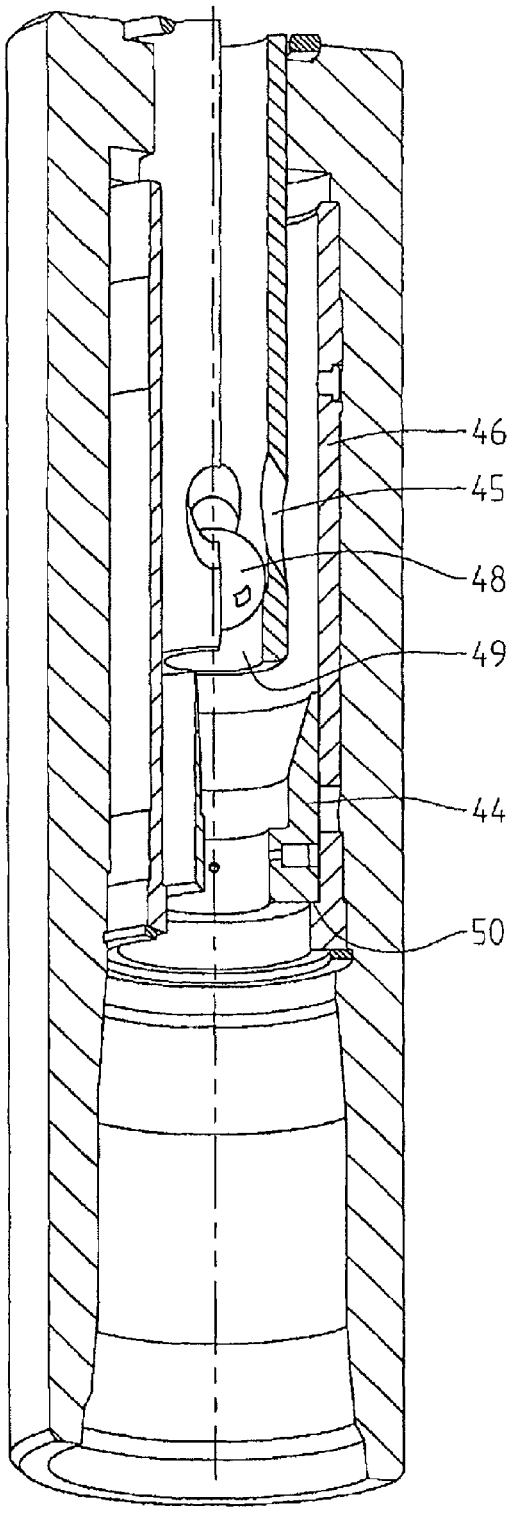
Figure 15:
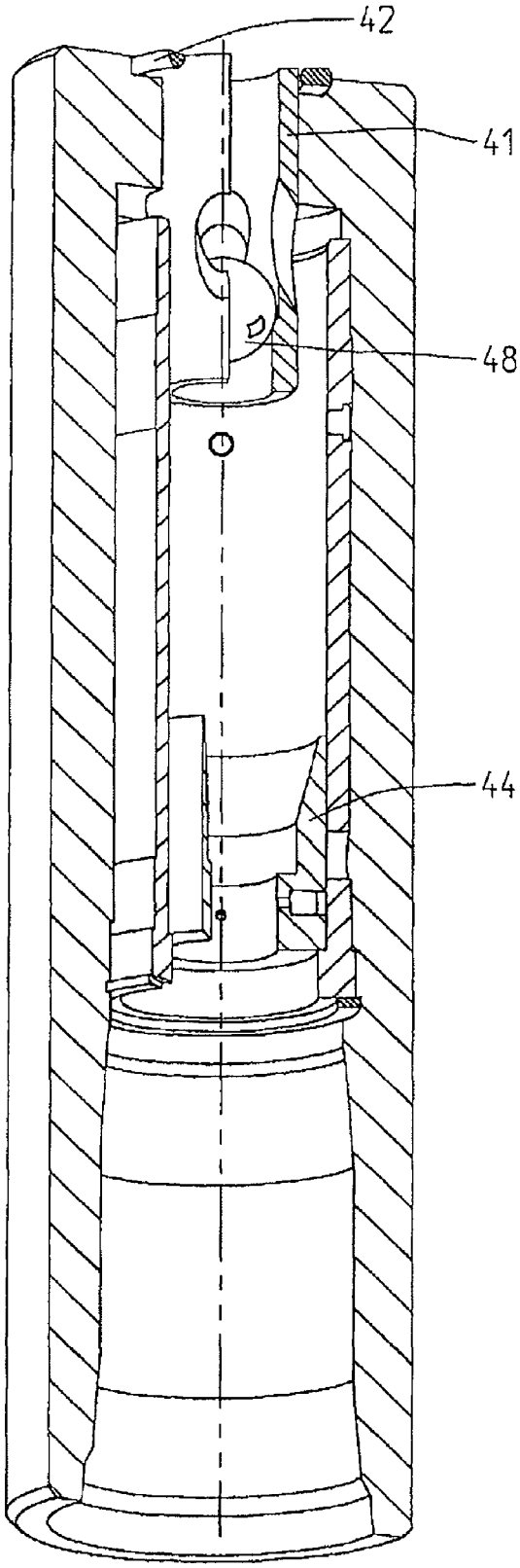

To release drive tube 11, an activation ball 48 may be launched from the surface which ultimately comes to rest against a narrowing 49 in the first end of extension tube 41. The application of ball 48 (as shown in FIG. 14) has the effect firstly of a mechanical impact on the shear pin 47 and secondly a closure of the axial mud passage and therefore an enormous increase in the pressure exerted on the piston 13 of the drive tube 11. The result is an almost immediate shearing of pin 47 (as shown in FIG. 14) and a downward sliding of drive tube 11. Due to the pressure created inside the space situated upstream of socket 44, socket 44 may be projected downwards as far as the position illustrated in FIG. 14, where it may be immobilized by a stop 50. The sliding of the drive tube 11 and therefore of the threaded sleeve 27 and extension tube 41 may be stopped before the extension tube 41 reaches sleeve 44 in its immobilized position. Consequently, the circulation of the mud may then be re-established through lateral holes 45. As illustrated in FIG. 14, when drive tube 11 is released, it can move axially along the length of tubular body 1, for example, when driven by piston 13. When the hydraulic pressure at piston 13 decreases, a return spring 42 (described below) may return drive tube 11 to its initial position, as shown for example in FIG. 15.

Figure 18:
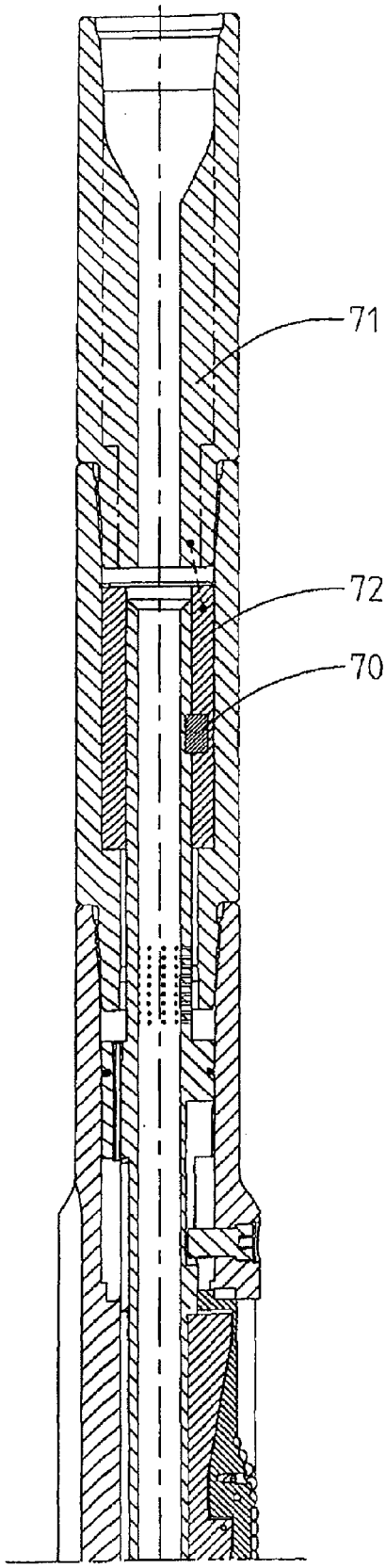
FIG. 18 illustrates a cross-section view of another example embodiment of an activation device for activating an underreaming tool according to the present disclosure.

As an additional example and not by way of limitation, (referring to FIG. 18) the above-mentioned activation device may comprise a bolt 70 that holds the drive tube 11 in its initial position and an electronic device 71 capable of releasing bolt 70 from drive tube 11. For example, electronic device 71 may be controlled using fluid pulses from an electrical control, well known in the art, situated at surface. When activated, electronic device 71 may control movement of bolt 70 by a bolt activator 72 to release drive tube 11. By holding drive tube 11 in its initial position, the activation device may keep blade element 5 retracted within guide channel 3, for example, while underreaming tool 0 is lowered into a borehole.

In particular embodiments, underreaming tool 0 may include a return spring 42 (see FIGS. 9 and 10) that bears firstly on extension tube 41 and secondly on a junction element 43, fixed to tubular body 1 which holds tubular body 1 in a string. In particular embodiments, return spring 42 may oppose any movement of drive tube 11 caused by piston 13 and may return drive tube 11 to its initial position when piston 13 ceases to exert a sufficient amount of force on drive tube 11 to overcome the force exerted by return spring 42 (e.g., when the hydraulic pressure at piston 13 drops below a threshold amount such that the force exerted on drive tube 11 by return spring 42 overcomes the force exerted on drive tube 11 by piston 13). In operation, when drive tube 11 is moved, for example, by hydraulic pressure at piston 13, return spring 42 may be compressed, and when the hydraulic pressure at piston 13 decreases, return spring 42 may return drive tube 11 to its initial position as illustrated in FIGS. 8 to 10.

Figure 16:
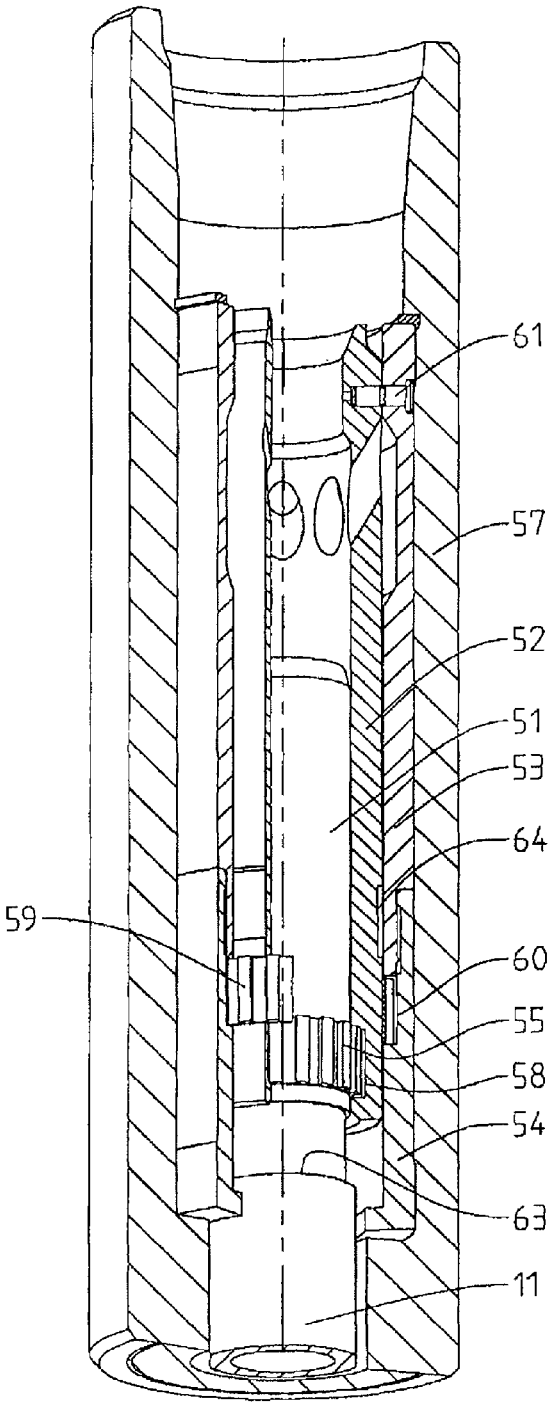
FIGS. 16 and 17 each illustrate a partially cut-away perspective view of a capture device in two different positions for capturing a drive tube according to an example embodiment of the present disclosure.
Figure 17:
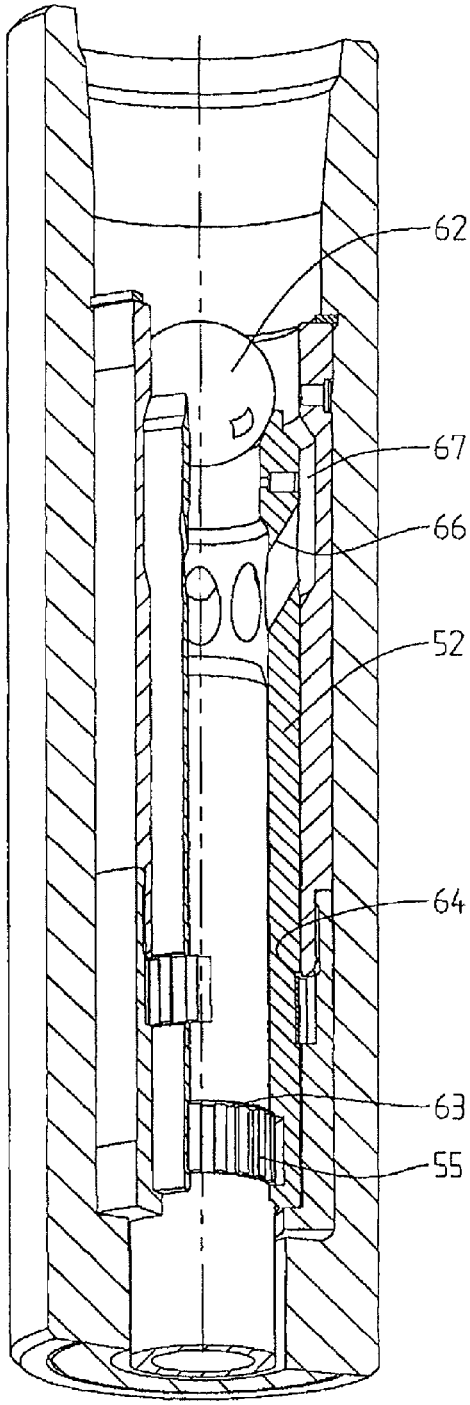

Referring to FIGS. 16 and 17, in particular embodiments, underreaming tool 0 may comprise a capture device operable to capture drive tube 11 in its initial position once return spring 42 returns drive tube 11 to its initial position. As an example and not by way of limitation, drive tube 11 may include a tubular extension 51 fixed to it. Extension 51 may be surrounded by a sleeve 52 capable of sliding over extension 51 and inside two successive sockets 53 and 54 fixedly connected together. Sockets 53 and 54 may be rigidly embedded inside a joining element 57 connected fixedly to tubular body 1 to allow its insertion in a string.

In particular embodiments, a first elastic clamping collar 55 may be housed in an internal groove 58 of sleeve 52 and may slide with sleeve 52 on extension 51. A second elastic clamping collar 59 may be housed in an internal groove 60 formed between sockets 53 and 54, such that clamping collar 59 may slide on sleeve 52. During operation, mud passes inside sleeve 52 to extension 51 and finally into drive tube 11.

When drive tube 11 is in its initial position, for example, when underreaming tool 0 is initially activated and in service, sleeve 52 may be held axially inside fixed socket 53 by a shear pin 61. When underreaming tool 0 is to be stopped, for example, in order to bring underreaming tool 0 to the surface, a second ball 62 with a diameter greater than that of the sleeve 52 may be sent into the string. Ball 62 may ultimately come to rest at the entrance to sleeve 52, blocking the passage in sleeve 52. Due to the mechanical impact ball 60 and the immediate increase in pressure, pin 61 is sheared enabling sleeve 52 to slide downstream.

During the sliding of sleeve 52, a peripheral groove 64 of sleeve 52 may fall into place over the second elastic clamping collar 59 such that clamping collar 59 is housed in groove 64, thus fixing together sleeve 52 and fixed sockets 53 and 54, and therefore the joining element 57 of tubular body 1. Next, when the pressure is reduced, first elastic clamping collar 55 may come to be housed in a peripheral groove 63 between extension 51 and drive tube 11, which is returned to its initial position, which secures extension 51 and drive tube 11 to the sleeve 52. In this position, drive tube 11 may be trapped by tubular body 1 such that it can no longer move. The upstream end of sleeve 52 may include lateral holes 66 so that the mud can, in this captured position, continue to flow by passing laterally around the ball 62 in a space 67 provided between the socket 53 and the sleeve 52, then through lateral holes 66, and finally into sleeve 52.

In particular embodiments, underreaming tool 0 may comprise a bolt which, in a closed position, holds the capture device axially in a non-activated position and an electrical control member, connected to the bolt and capable of controlling movement of the bolt in an open position in which the capture device is moved in its captured position.

Although the present disclosure has been described in several embodiments, a myriad of changes, substitutions, and modifications may be suggested to one skilled in the art, and it is intended that the present disclosure encompass such changes, substitutions, and modifications as fall within the scope of the present appended claims.

What is claimed is:

1. A method for assembling an underreaming tool, comprising the steps of:

providing a tubular body, a drive tube, at least one blade element, at least one wedge element, and a stop mechanism, wherein:

the tubular body comprises:

an axial cavity configured to house the drive tube, the axial cavity spanning an entire length of the tubular body; and at least one guide channel configured to, at least, partially house the at least one blade element and the at least one wedge element, the at least one guide channel comprising an opening in the tubular body that opens into the axial cavity;

the drive tube comprises at least one longitudinal groove axially disposed along a length of the drive tube;

the at least one wedge element comprises:

a first side having at least one lateral projection configured to axially slide into the at least one longitudinal groove to couple the at least one wedge element to the drive tube; and a second side configured to slideably couple the at least one wedge element to the at least one blade element; and the stop mechanism comprises a threaded sleeve configured to screw onto the drive tube such that the threaded sleeve directly locks the at least one wedge element in the at least one longitudinal groove once the at least one lateral projection is slid into the at least one longitudinal groove and the threaded sleeve is screwed onto the drive tube; and coupling the at least one wedge element to the at least one blade element;

housing the at least one blade element in the at least one guide channel;

inserting the drive tube into the axial cavity;

sliding the at least one lateral projection into the at least one longitudinal groove; and screwing the threaded sleeve onto the drive tube.

2. The method of claim 1, wherein:

the at least one longitudinal groove comprises at least one lip; and the at least one lateral projection axially slides into the at least one longitudinal groove by sliding beneath the at least one lip.

3. The method of claim 2, wherein the at least one lip prevents radial movement of the at least one wedge element relative to the drive tube once the at least one lateral projection is slid underneath the at least one lip and the threaded sleeve prevents axial movement of the at least one wedge element relative to the drive tube once the threaded sleeve is screwed onto the drive tube.

4. The method of claim 1, wherein:

the at least one longitudinal groove comprises a splay disposed in a central section of the at least one longitudinal groove;

the at least one lateral projection comprises a first set of lateral projections and a second set of lateral projections; and sliding the at least one lateral projection into the at least one longitudinal groove comprises sliding the first set of lateral projections into the at least one longitudinal groove through the splay and the second set of lateral projections into the at least one longitudinal groove through an end of the at least one longitudinal groove.

5. The method of claim 1, wherein:

the stop mechanism comprises a stop wall that defines a first end of the at least one longitudinal groove;

the threaded sleeve, after being screwed onto the drive tube, closes a second end of the at least one longitudinal groove forming an opposing wall to the stop wall; and the stop mechanism locks the at least one wedge element into the at least one longitudinal groove by trapping the first side of the at least one wedge element between the stop wall and the threaded sleeve once the at least one lateral projection is slid into the at least one longitudinal groove.

6. The method of claim 1, wherein:

housing the at least one blade element in the at least one guide channel comprises inserting the at least one blade element into the axial cavity through the at least one guide channel and raising the at least one blade element into the at least one guide channel;

inserting the drive tube into the axial cavity comprises inserting the drive tube into a first end of the tubular body; and screwing the threaded sleeve onto the drive tube comprises, inserting the threaded sleeve into a second end opposite the first end of the tubular body after inserting the drive tube into the tubular body, and screwing the threaded sleeve onto the drive tube inside the tubular body.

* * * * *

UNITED STATES PATENT AND TRADEMARK OFFICE

CERTIFICATE OF CORRECTION

PATENT NO. : 7,958,951 B2
APPLICATION NO. : 12/645865
DATED : June 14, 2011
INVENTOR(S) : Lassoie et al.

It is certified that error appears in the above-identified patent and that said Letters Patent is hereby corrected as shown below:

Title page Item [75] Inventors: Please correct the order of the Third and Fourth Inventors, by deleting "Philippe Fanuel, Brussels (BE); Olivier Mageren, Gilly (BE)" and replace with -- Olivier Mageren, Gilly (BE); Philippe Fanuel, Brussels (BE) --

Title page Item [63] After "Continuation of application No. 12/100,797, filed on Apr. 10, 2008, now Pat. No. 7,654,342" please insert -- which is a continuation application No. PCT/BE2005/000145, filed Oct. 11, 2005 --

Signed and Sealed this
Eleventh Day of October, 2011

David J. Kappos

David J. Kappos
*Director of the United States Patent and Trademark Office*